US005476755A

United States Patent [19]

Nakayama et al.

[11] Patent Number: 5,476,755

[45] Date of Patent: Dec. 19, 1995

[54] IMAGE FORMING ELEMENT AND IMAGE FORMING METHOD

[75] Inventors: Noritaka Nakayama; Norio Miura; Yoriko Nakayama; Tawara Komamura; Toshihisa Takeyama, all of Hino, Japan

[73] Assignee: Konica Corporation, Tokyo, Japan

[21] Appl. No.: 339,341

[22] Filed: Nov. 14, 1994

[30] Foreign Application Priority Data

Nov. 19, 1993 [JP] Japan ..... 5-290909
Dec. 28, 1993 [JP] Japan ..... 5-336737

[51] Int. Cl.[6] ..... G03C 1/735

[52] U.S. Cl. ..... 430/336; 430/495; 430/340; 430/342; 430/343; 430/341; 430/936; 430/338; 430/337

[58] Field of Search ..... 430/495, 336, 430/340, 342, 343, 341, 936, 338, 337

[56] References Cited

U.S. PATENT DOCUMENTS

| | | | |
|---|---|---|---|
| 4,247,625 | 1/1981 | Fletcher et al. | 430/336 |
| 4,308,341 | 12/1981 | Do Minh | 430/336 |
| 4,318,977 | 3/1982 | Do Minh | 430/336 |
| 4,343,891 | 8/1982 | Aasen et al. | 430/337 |
| 4,410,623 | 10/1983 | Do Minh et al. | 430/341 |
| 4,954,414 | 9/1990 | Adair et al. | 430/138 |
| 5,166,041 | 11/1992 | Murofushi et al. | 430/340 |

FOREIGN PATENT DOCUMENTS

| | | |
|---|---|---|
| 0101026 | 8/1977 | Japan . |
| 0139739 | 2/1982 | Japan . |
| 0190944 | 11/1982 | Japan . |
| 1496944 | 1/1978 | United Kingdom . |
| 1497452 | 1/1978 | United Kingdom . |
| 1497453 | 1/1978 | United Kingdom . |

OTHER PUBLICATIONS

Tanaka, Research Disclosure, vol. 231, Item 23121, Jul. 1983, Kenneth Mason Publications, Ltd.

*Primary Examiner*—Thomas R. Neville

*Attorney, Agent, or Firm*—Frishauf, Holtz, Goodman, Langer & Chick

[57] ABSTRACT

An image forming element and an image forming method using the same are disclosed. The element comprises a support having thereon a image forming layer comprising a binder, an aromatic aldehyde, a cobalt (III) complex represented by formula I, and a compound represented by formula II or formula III;

$$Co^{3}+(L)p(X)q \quad (I)$$

wherein L is a coordination compound capable of forming a complex compound with the cobalt cation and at least one of which is $NH_3$ or a primary amine; X is a counter anion; p is an integer of 1 to 6; when p is 2 to 6, the plural Ls may be the same or different; and q is an integer of 1 to 3, (II)

wherein lig is a coordination compound capable of forming with the cobalt cation; $R_1$, $R_2$, $R_3$ and $R_4$ are each independently an alkyl group, an aryl group, an aralkyl group, an alkenyl group, an alkinyl group, a cycloalkyl group, a heterocyclic group or a cyano group; $n_1$ is an integer of 1 to 6, when $n_1$ is 2 to 6, the plural ligs may be the same or different; and m is an integer of 1 to 3, (III)

wherein Dye is a cationic dye; $R_5$, $R_6$, $R_7$ and $R_8$ are each independently an alkyl group, an aryl group, an aralkyl group, an alkenyl group, an alkinyl group, a heterocyclic group or a cyano group; $n_2$ is an integer of 1 to 3, when $n_2$ is 2 or 3, the plural counter ions may be the same or different.

17 Claims, No Drawings

IMAGE FORMING ELEMENT AND IMAGE FORMING METHOD

FIELD OF THE INVENTION

This invention relates to a novel image forming element and an image forming method and, particularly, to an image forming element for forming an image and an image forming method, in which the photoreduction reaction of a cobalt complex.

BACKGROUND OF THE INVENTION

As for an image forming element in which a cobalt complex is used, the elements given in, for example, Japanese Patent Publication Open to Public Inspection (hereinafter referred to as JP OPI Publication) Nos. 50-139722/1975, 50-139723/1975 and 50-139724/1975 have been known. Further, the image forming elements, in which a cobalt complex and a phthalaldehyde are used, are described in the above-given patents and JP OPI Publication Nos. 52-101026/1977 and 57-63527/1982.

The elements described in the above-mentioned patents are excellent in such a point that an image can be formed in a simple and easy dry process and by the functions of phthalaldehyde and amine, upon heating the elements after exposing them to light.

However, a cobalt complex is short of photosensitivity in itself, so that it is limited only to slightly show a low photosensitivity. With an image forming element described in the above-mentioned patents, a sensitivity is therefore provided thereto by making use of such a photoreducing agent as a naphthoquinone derivative and such a photoxidizing agent as a naphthol derivative, as a photosensitive substance. However, not only it cannot be said that the resulting photosensitivity is satisfactorily high, but there has been such a defect that the subject element is inferior in preservability because a naphthoquinone derivative and a naphthol derivative are reduced or oxidized in preservation, or that a stain is produced by a photoreducing agent or a photoxidizing agent after completing an image formation.

SUMMARY OF THE INVENTION

It is an object of the invention to improve the above-mentioned problems of the conventional art.

It is, therefore, an object of the invention to provide an image forming element capable of forming an image in a simple and easy dry process and having a high photosensitivity and an excellent preservability.

Another object of the invention is to provide an image forming element for obtaining an image high in density and few in fogginess, and further to provide an image forming method therefor.

A further object of the invention is to provide a highly photosensitive image forming element photosensitive to a long wavelength light of not shorter than 500 nm, and further to provide an image forming method therefor.

The image forming element of the invention comprises a support having thereon a layer comprising an aromatic dialdehyde, a cobalt (III) complex compound represented by formula I, and a compound represented by formula II or formula III:

$$Co^{3+}(L)_p(X)_q \qquad (I)$$

in which L is a coordination compound capable of forming a complex compound with a cobalt cation and at least one of which is $NH_3$ or a primary amine; X is a counter anion; p is an integer of 1 to 6, when p is 2 to 6, a plurality of L may be the same or different; and q is an integer of 1 to 3, (II)

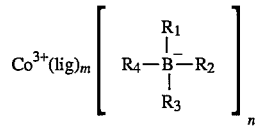

in which lig is a coordination compound capable of forming a complex compound with the cobalt cation; $R_1$, $R_2$, $R_3$ and $R_4$ are each independently an alkyl group, an aryl group, an aralkyl group, and alkenyl group, an alkinyl group, a cycloalkyl group, a heterocyclic group or a cyano group; m is an integer of 1 to 6, when m is 2 to 6, a plurality of lig may be the same or different; and $n_1$ is an integer of 1 to 3, (III)

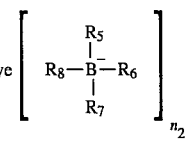

in which Dye is a cationic dye; $R_5$, $R_6$, $R_7$ and $R_8$ are each independently an alkyl group, an aryl group, an aralkyl group, an alkenyl group, an alkinyl group, a heterocyclic group or a cyano group; $n_2$ is an integer of 1 to 3, when n is 2 or more, a plurality of counter anions may be the same or different. It is preferable that at least one of lig in formula II is $NH_3$ or a primary amine compound.

In an image forming method using the above element, the image forming element is exposed imagewise to light and heated.

The element of the invention comprises (1) a light-sensitive compound capable of being activated by receiving light, (2) an amine-releasing compound capable of releasing $NH_3$ or a primary amine upon reaction with the light-sensitive compound, and (3) an aromatic aldehyde capable of forming an image by reaction with the HN3 or primary amine released from the amine releasing compound. The compound represented by formula II or III is functions as light-sensitive compound and reduces the amine-releasing compound of formula I to form an image, when the element is exposed to light. When lig in formula II is $NH_3$ or a primary amine, compound of formula II is overlap with compound of formula I and the compound of formula II can have both of the function of light-sensitive compound and amine-releasing compound.

DETAILED DESCRIPTION OF THE INVENTION

A cobalt complex represented by formula I will be detailed.

In formula I, L represents a coordination compound capable of forming the complex with a cobalt cation. For forming an image, amino acid and the derivatives thereof or a primary amine are preferred.

X represents a counter anion including, typically, those of benzylate, thiocyanate, trifluoroacetate, heptafluorobutyrate, perchlorate, hexafluorophosphate, nitrate, salicinate, chloride, fluoride, iodide or bromide. Among them, trifluoroacetate is particularly preferable.

The concrete examples of the cobalt complexes Co of the invention include the following compounds which may be synthesized with reference to the method described in JP OPI Publication No. 59-95529/1984.

Co-1: hexammine cobalt(III) trifluoroacetate,

Co-2: tris(ethylenediamine)cobalt(III) perchlorate,

Co-3: hexammine cobalt(III) benzylate, Co-4: hexammine cobalt(III) thiocyanate, Co-5: hexammine cobalt(III) acetate, Co-6: hexammine cobalt(III) chloride, Co-7: hexammine cobalt(III) perchlorate, Co-8: chloropentammine cobalt(III) perchlorate, Co-9: bromopentammine cobalt(III) perchlorate, Co-10: aquapentammine cobalt(III) nitrate, Co-11: aquapentammine cobalt(III) dichloroacetate, Co-12: bis(ethylenediamine)bisazido cobalt(III) trifluoroacetate, Co-13: tris(1,3-propanediamine) cobalt(III) trifluoroacetate, Co-14: trinitrotris(methylamine) cobalt(III), Co-15: nitropentammine cobalt(III) chloride, Co-16: nitratopentammine cobalt(III) chloride, and Co-17: carbonatotetrammine cobalt(III) chloride Co-18: tris(glycine)cobalt(III) trifluoroacetate Now, the cobalt complexes represented by formula II will be detailed.

As for the concrete examples of $R_1$ through $R_4$, the following groups may be given.

The alkyl groups include, for example, a straight-chained or branched alkyl group, and each group of methyl, ethyl, butyl, i-butyl, hexyl, octyl and stearyl may be given.

The alkenyl groups preferably include those having 2 to 20 carbon atoms. As for the alkinyl groups, those having 2 to 20 carbon atoms are also preferable. As for the cycloalkyl groups, those having 5- to 7-membered ring are preferable.

As for the aralkyl groups, a benzyl group is preferable.

As for the heterocyclic groups, those having an aromaticity, including, for example, a thienyl group.

As for the aryl groups, a phenyl group and a naphthyl group are preferable.

The above-given groups may have a substituent. As for the substituents include, for example, a halogen atom, a cyano group, a nitro group, an alkyl group, an aryl group, a hydroxyl group, an amino group including an alkyl-substituted amino group, an alkoxy group, a carbamoyl group, —$COOR_3$ and $OCOR_3$, in which $R_3$ represents an organic group such as an alkyl group and an aryl group.

lig represents a coordination compound capable of forming a complex upon making a reaction with a cobalt cation.

In a cobalt complex of formula I, the cobalt cation is a Lewis acid and the coordination compound is a Lewis base. Almost all Lewis bases may be used for the coordination compound. However, it is preferable to use $NH_3$, amino acid and the derivatives thereof, or primary amine so as to form an image.

The primary amines of the invention include, for example, methylamine, ethylamine and butylamine. It is particularly preferable to use a coordination compound comprising an $NH_2$ group as at least one of the ligands thereof, including, for example, $NH_3$, ethylene diamine and glycine amide.

In the invention, when making combination use of a cobalt complex of formula I with a cobalt complex Co represented by the above-given formula II, and an aromatic dialdehyde derivative, such an unexpected effect can be displayed that an image can be formed by only heating it after exposing it to light. Further, the preservability of the subjects element can be improved and no image stain can be produced, because it is not needed to add any photoreducing agent nor photoxidizing agent thereto. In the above element the cobalt complex of formula II functions as a photoxidizing agent. In addition thereto, The photosensitivity thereof can be higher than in the case of making use of a photoreducing agent and/or a photoxidizing agent.

In a compound represented by formula I of the invention, when a counter anion denoted by X is

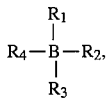

the compound is coincident with a compound represented by formula II in which lig represents $NH_3$ or primary amine. Accordingly, the compound has a combination of the both functions of the compounds respectively represented by formulas I and II. Therefore, an element having a layer containing the compound and an aromatic dialdehyde can also form an image. Such an image forming element as mentioned above shall be included in the scope of the invention.

Cobalt complex of formula II of the invention may be added preferably in an amount within the range of 0.01 to 5 g per $m^2$ of a element used, provided that the amount thereof may be varied according to the kinds and application thereof.

lig in the complex of formula II forms a complex together with a cobalt cation. After lig is released from the complex, it is also allowed to form an image upon making a reaction directly with phthalaldehyde. It is further allowed to form an image in such a manner that a coordination compound is released from a complex having formula I by reducing the cobalt complex having formula I. In the invention, the latter is preferred. Such a coordination compound as mentioned above include, preferably, a multidentate compound such as picoline amide, diethylene triamine, triethylene tetramine, biguanidine and tetrakis(2-aminoethyl)ethylene diamine.

The concrete examples of a cobalt complex of formula II of the invention include the following compounds. These compounds may be synthesized with reference to the method described in JP OPI Publication No. 59-95529/1984.

| Complex | $R_1$ | $R_2$ | $R_3$ | $R_4$ |
|---|---|---|---|---|
| | $Co^{3+}(NH_3)_6\left(R_4-\overset{\overset{R_1}{\vert}}{\underset{\underset{R_3}{\vert}}{B}}-R_2\right)_3$ | | | |
| C-1 | $-C_6H_5$ | $-C_6H_5$ | $-C_6H_5$ | $-C_6H_5$ |
| C-2 | $-C_4H_9$ | $-C_6H_5$ | $-C_6H_5$ | $-C_6H_5$ |
| C-3 | $-C_4H_9$ | $-C_4H_9$ | $-C_4H_9$ | $-C_4H_9$ |
| C-4 | $-C_4H_9$ | 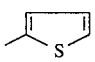 | 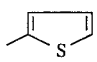 | 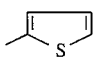 |
| C-5 | $-C_4H_9(i)$ | $-C_6H_5$ | $-C_6H_5$ | $-C_6H_5$ |

-continued

| Complex | $R_1$ | $R_2$ | $R_3$ | $R_4$ |
|---|---|---|---|---|
| | $Co^{3+}(NH_2CH_2CH_2NH_2)_3\left(R_4-\overset{R_1}{\overset{\vert}{B}}-R_2 \atop R_3\right)_3$ | | | |
| C-6 | $-C_6H_5$ | $-C_6H_5$ | $-C_6H_5$ | $-C_6H_5$ |
| C-7 | $-C_4H_9$ | $-C_6H_5$ | $-C_6H_5$ | $-C_6H_5$ |
| C-8 | $-C_4H_9$(i) | $-C_6H_5$ | $-C_6H_5$ | $-C_6H_5$ |
| | $Co^{3+}(NH_2CH_2CH_2NHCH_2CH_2NH_2)_3\left(R_4-\overset{R_1}{\overset{\vert}{B}}-R_2 \atop R_3\right)_3$ | | | |
| C-9 | $-C_4H_9$ | $-C_6H_5$ | $-C_6H_5$ | $-C_6H_5$ |
| C-10 | $-C_4H_9$ | $-C_4H_9$ | $-C_4H_9$ | $-C_4H_9$ |
| C-11 | $-C_6H_5$ | $-C_6H_5$ | $-C_6H_5$ | $-C_6H_5$ |
| | $Co^{3+}(NH_2CH_2CONH_2)_3\left(R_4-\overset{R_1}{\overset{\vert}{B}}-R_2 \atop R_3\right)_3$ | | | |
| C-12 | $-C_6H_5$ | $-C_6H_5$ | $-C_6H_5$ | $-C_6H_5$ |
| C-13 | $-C_4H_9$ | $-C_6H_5$ | $-C_6H_5$ | $-C_6H_5$ |
| C-14 | $-C_4H_9$ | $-C_4H_9$ | $-C_4H_9$ | $-C_4H_9$ |
| C-15 | 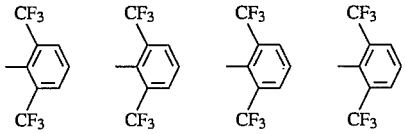 | | | |
| | $Co^{3+}(NH_2\overset{CH_3}{\overset{\vert}{C}}HCH_2NH_2)_3\left(R_4-\overset{R_1}{\overset{\vert}{B}}-R_2 \atop R_3\right)_3$ | | | |
| C-16 | $-C_6H_5$ | $-C_6H_5$ | $-C_6H_5$ | $-C_6H_5$ |
| C-17 | $-C_4H_9$ | $-C_6H_5$ | $-C_6H_5$ | $-C_6H_5$ |
| C-18 | $-C_4H_9$(i) | $-C_6H_5$ | $-C_6H_5$ | $-C_6H_5$ |

$-C_6H_5$ represents phenyl;
$-C_4H_9$ represents butyl.

Now, the dye compounds represented by the above-given formula III will be detailed.

In formula III, Dye represents a cationic dye. The examples thereof applicable to the invention include well-known spectrally sensitizing dyes for silver halide emulsion use. The examples of such a sensitizing dye as mentioned above include a cyanine dye or a composite cyanine dye and a rhodacyanine dye and a styryl dye, each of which is described in U.S. Pat. Nos. 1,939,201, 2,072,908, 2,739,149, 2,213,995, 2,493,748 and 2,519,001, West German Patent No. 929,080 and British Patent No. 505,979.

Among these dyes, cyanine dyes and stiryl dyes are preferable, which are represented by the following formula D-1;

$$B-(L_1=L_2)_n-L_3=B' \qquad \text{(D-1)}$$

wherein, B is a nitrogen-containing hetrocyclic group; B' is an aryl group or a heterocyclic group; and n is an integer of 0 to 3.

A nitrogen-containing heterocyclic group represented by B is preferably a pyridine, quinoline, oxazole, benzoxazole, naphthoxazole, thiazole, benzthiazole, naphthothiazole, indolenine, pyrrole and indole.

Aryl groups represented by B' include a phenyl group, a naphthyl group and julolidyl group, and heterocyclic group represented by B' include a pyridyl group, a quinolyl group, an isoquinolyl group, a pyrrolyl group, a pyrazolyl group, an imidazole group, an indolyl group, a furyl group, and thienyl group. The above aryl groups and heterocyclic groups include those each having a substituent. The substituents include an alkyl group, a cycloalkyl group, an alkenyl group, an aryl group, a halogen atom, an alkoxycarbonyl group, an aryloxycarbonyl group, a carboxyl group, a cyano group, a hydroxyl group, a mercapto group, an amino group, an alkoxyl group, an aryloxyl group, an acyl group, a carbamoyl group, an acylamino group a ureido group, a sulfonamido group and a sulfamoyl group. Among the above substituents the followings are preferable; an alkyl group having 1 to 8 carbon atoms such as a methyl, ethyl, t-butyl, n-octyl, 2- hydroxyethyl or 2-ethoxyethyl group; a hydroxyl group; a cyano group; a halogen atom such as fluorine atom or chlorine atom; an alkoxyl group having 1 to 6 carbon atoms such as a methoxy, ethoxy, 2-hydroxyethoxy, methylenedioxy or n-butoxy group; a substituted amino group such as a dimethylamino, diethylamino, di(n-butyl)amino, N-ethyl-N-hydroxyethyl-amino, N-ethyl-N-methanesulfonamidoethylamino, morpholino, piperidino or pyrrolidino group; a carboxyl group, a sulfonamido group such as a methansulfonamido or benzenesuolfonamido group; and a sulfamoyl group such as a sulfamoyl, methylsulfamoyl or phenylsulfamoyl group. Two or more of these substituents may be used in combination. A methine group represented by $L_1$, $L_2$ and $L_3$ includes one having a substituent. Exemplified substituents are an alkyl group having 1 to 6 carbon atoms such as a methyl, ethyl or hexyl group; an aryl group such as a phenyl, tolyl or 4-hydroxyphenyl group; an aralkyl group such as a benzyl or phenetyl group; a heterocyclic group such as a pyridyl, furyl, ethynyl group; a substituted amino group such as a dimethylamino, dimethylamino or anilino group; an alkylthio group such as a methylthio group; a carbamoyl group such as dimethylcarbamoyl group; and a alkoxycarbonyl group such as methoxycarbonyl group.

Concrete example of the dyes usable in the invention and synthesis method thereof are described on JP OPI Publication Nos. 52-92716/1977, 55-120030/1980, 55-155350/1980, 55-155351./1980, 56-12639/1981, 2-1838/1990 and 2-1839/1990, WO No. 88/04794, U.S. Pat. Nos. 4,861,700 and 4,950,586 and EP No. 489973.

In formula III $R_5$, $R_6$, $R_7$ and $R_8$ represent each a group capable of coupling to boron through a carbon atom, such as an alkyl group, an aryl group, an aralkyl group, an alkenyl group, an alkinyl group, a heterocyclic group and a cyano group. It is preferable that at least one of $R_5$ through $R_6$ represents an alkyl group or an aralkyl group. It is particularly preferable to be such a combination that $R_5$, for example, represents an alkyl group or an aralkyl group and $R_6$ through $R_8$ represent each an aryl group or a heterocyclic group.

The concrete examples of $R_5$ through $R_8$ include the following groups.

The alkyl groups include, for example, a straight-chained or branched alkyl group and, typically, a methyl group, an ethyl group, a butyl group, an isobutyl group, a hexyl group, an octyl group and a stearyl group. The alkenyl groups include, preferably, those having 2 to 20 carbon atoms. The alkinyl groups include, preferably, those having 2 to 20 carbon atoms. The cycloalkyl groups include, preferably, those having 5- to 7-membered ring. The aralkyl groups include, preferably, a benzyl group.

The heterocyclic groups include, preferably, those having an aromaticity, such as a thiophene group. The aryl groups include, preferably, a phenyl group and a naphthyl group.

These groups may also be substituted. The substituents thereto include, for example, a halogen atom, a cyano group, a nitro group, an alkyl group, an aryl group, a hydroxy group, an amino group including an alkyl-substituted amino group, an alkoxy group, a carbamoyl group, —$COOR_5$ and —$OCOR_5$, in which $R_5$ represents an organic group such as an alkyl group and an aryl group.

The dye compounds of the invention can readily be obtained by making reaction of the counter anion of a well-known dye with a solvent comprising sodium tetraphenyl borate and water or methanol.

The concrete examples of the dye compounds applicable to the invention will be given below.

D-1

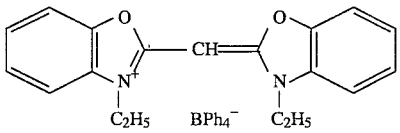

D-2

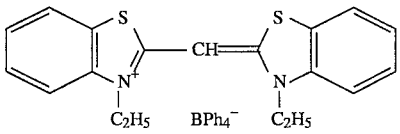

D-3

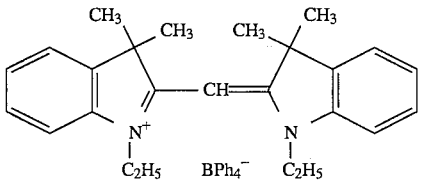

D-4

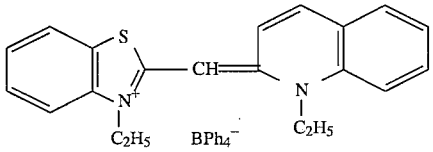

D-5

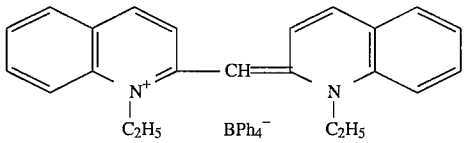

D-6

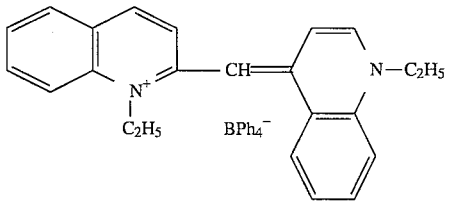

D-7

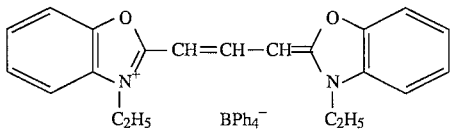

D-8

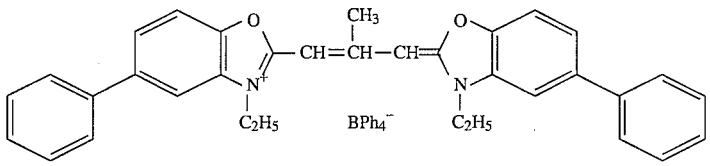

-continued
D-9
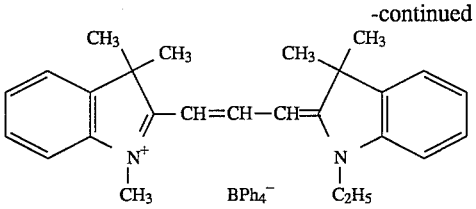
D-10
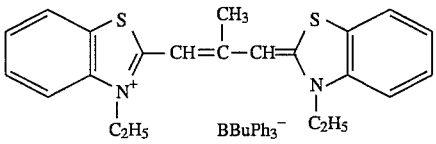
D-11
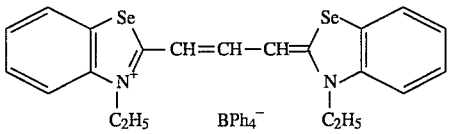
D-12
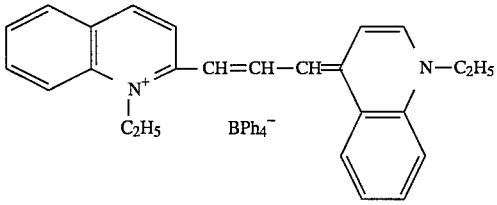
D-13
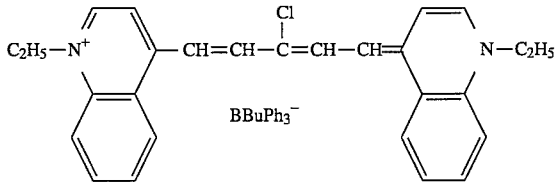
D-14
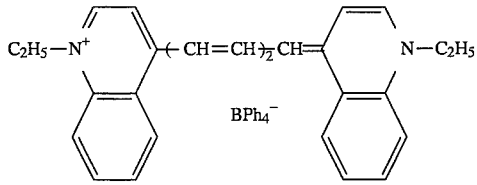
D-15
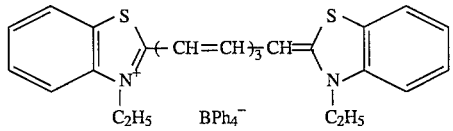
D-16
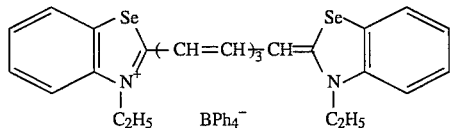
D-17
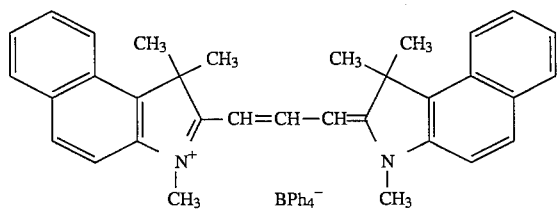

-continued
D-18
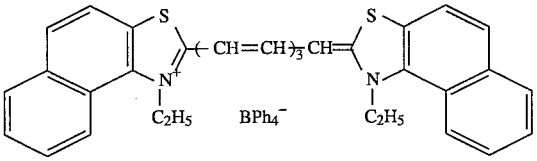
D-19
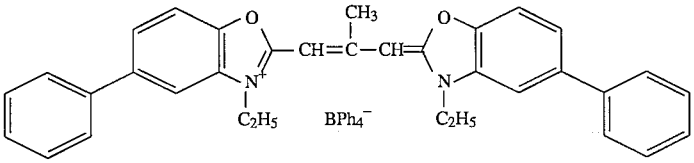
D-20
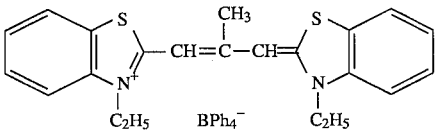
D-21
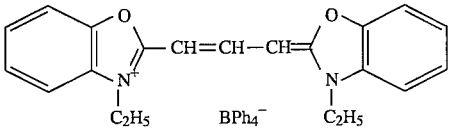
D-22
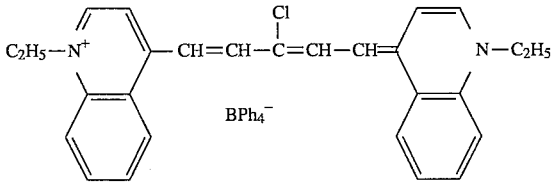
D-23
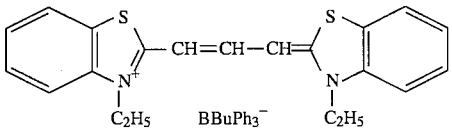
D-24
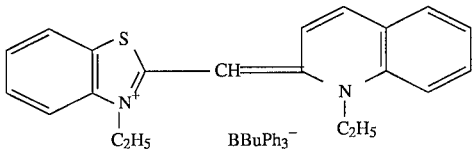
D-25
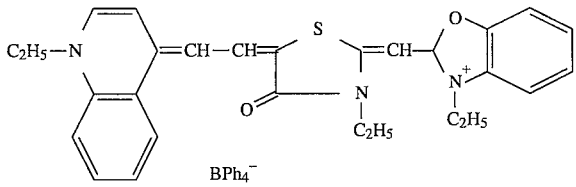
D-26
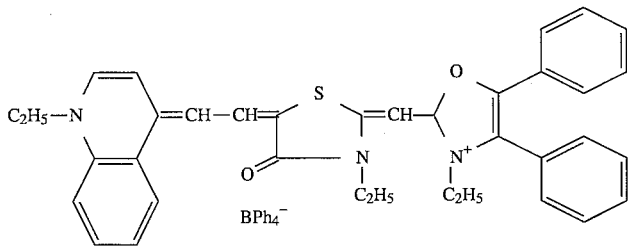

-continued
D-27
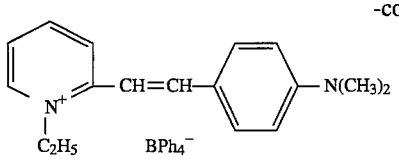
D-28
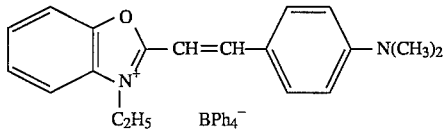
D-29
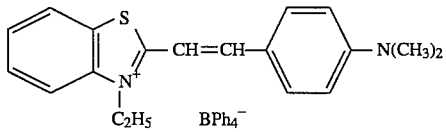
D-30
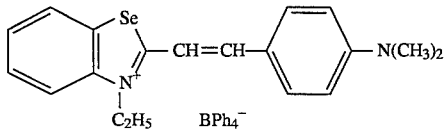
D-31
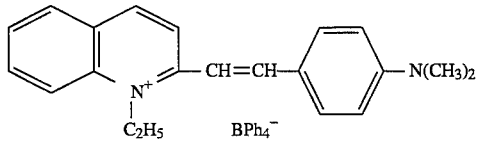
D-32
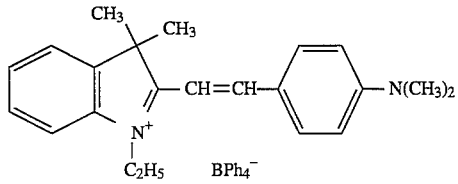
D-33
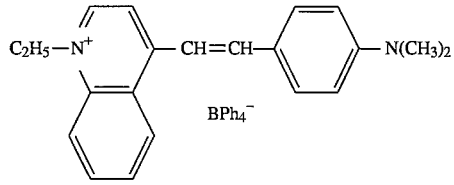
D-34
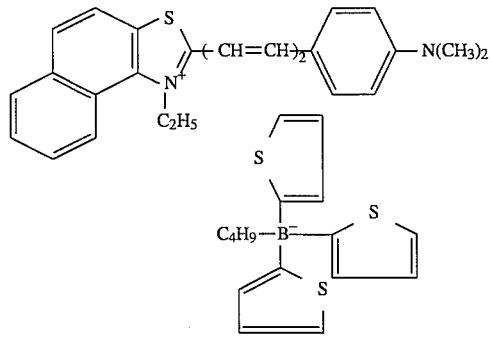

-continued
D-35
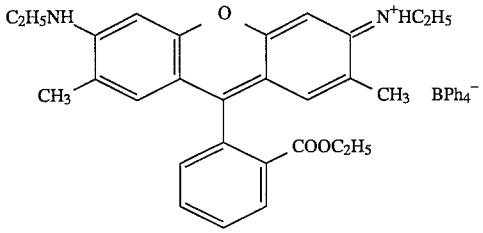
D-36
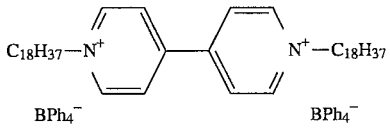
D-37
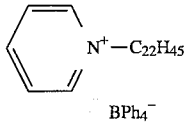
D-38
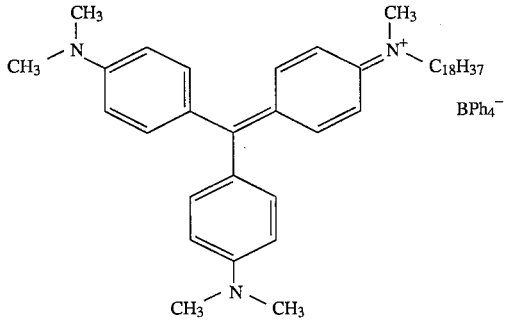
D-39
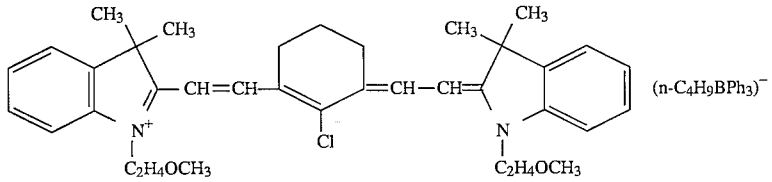
D-40
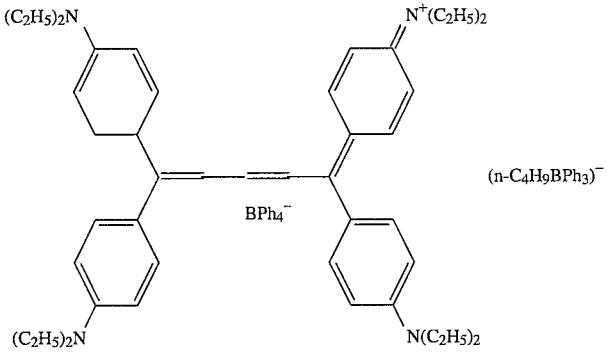

-continued

D-41

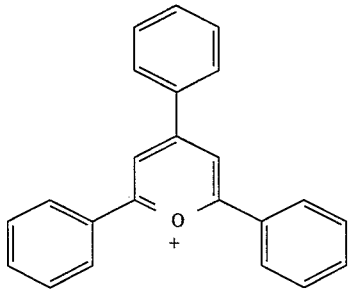

$(n\text{-}C_4H_4BPh_3)^-$

A image forming element of the invention containing a dye compound represented by the foregoing formula III has a spectral sensitivity corresponding to the spectral absorptivity of a dye used therein. Therefore, the element can be an image forming element having a desired spectral sensitivity when selecting a suitable dye and, particularly, it can be an image forming element having a photosensitivity in a wavelength region of 500 nm or longer, that is suitable for an image formed by exposing it to a laser beam.

Aromatic dialdehyde compounds applicable to the invention are preferably ones represented by the following formula IV;

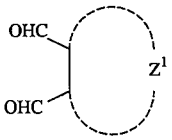

(IV)

wherein $Z^1$ is a group of atoms necessary to form an aromatic ring which may have a substituent. Preferable examples of the substituent include an alkyl group such as a t-butyl group, decyl group, dodecyl group and tetradecyl group; an aryl group such as a naphthyl group; an aralkyl group such as a phenylbutyl group; an alkoxyl group such as an octyloxyl group and tetradecyloxyl group; an amino group including a substituted amino group such as an octylamino group, a dodecylamino group; an acyl group such as a lauroyl group and a myristoyl group; an acylamino group such as an acetoamido group, lauroylamino group and a myristoylamino group; a hetero-cyclic group such as a benzothienyl, an isobenzofuranyl group, an indolyl group, an iosindolyl group and a quinolyl group; a —COOR group and a —OCOR group in which R is an organic group such as an alkyl group or an aryl group. The above substituents each may further have a substituent such as an alkyl group, an aryl group, an alkoxyl group, a hydroxyl group, a halogen atom, an amino group including an alkyl substituted amino group, an acyl group, an acylamino group, a nitro group, a cyano group, a carbamoyl group, a —COOR group or —OCOR group, in which R is an organic group such as an alkyl group or an aryl group. The substituent of the aromatic ring may be linked with the aromatic ring through a divalent linking group such as —NHCO—, —CONH—, —$NHSO_2$—, —$SO_2NH$—, —$NHCOCH_2$—, —$CH_2CONH$—, —O—, —S—, —$SO_2$—, —COO— or —OCO—. Among the dialdehyde compounds represented by formula IV, o-phthalaldehyde and substituted o-phthataldehyde are most preferable.

It also includes a condensed ring formed of a ring for forming phthalaldehyde and other ring, such as naphthalene dialdehyde.

A phthalaldehyde derivative may be added preferably in an amount within the range of 0.5 to 30 mols per mol of a cobalt complex represented by formula I used.

As for a preferable embodiment of the invention, the element has a photosensitive layer comprising a support bearing thereon a cobalt complex of formula I, a cobalt complex of formula II or dye compound of formula III, including the case in which a cobalt complex of formula II is used as a cobalt complex of formula I, and a binder. For the purpose of improving the preservability of an element, such an embodiment is also preferable that the photosensitive layer of the element is composed of separate sublayers containing a cobalt complex of formula I, and a cobalt complex of formula II or dye compound of formula III in one sublayer and an aromatic dialdehyde in another sublayer respectively.

A cobalt complex of the invention may be added preferably in an amount within the range of 0.01 to 5 g per $m^2$ of an element used, provided that the amount thereof added may be varied according to the kinds and application of the cobalt complex.

A cobalt compound having formula II of the invention or a dye having formula III of the invention may be added preferably in an amount within the range of 0.01 to 5 g per $m^2$ of an element used.

The weight ratio of a cobalt complex of formula II or a dye compound of formula III to a cobalt complex of formula I is preferable to be within the range of 0.01 to 0.5.

A binder applicable to the invention includes, preferably, a water-soluble binder such as gelatin, and polyvinyl alcohol and a solvent-soluble polymer such as acrylic resin, methacrylic resin, polystyrene, polycarbonate, polysulfone, polyether sulfone, polyvinyl butyral, polyvinyl acetal, nitrocellulose and ethyl cellulose. These binders may be used not only by dissolving them independently or in combination in an organic solvent, but also in the form of a latex dispersion. Such a binder as mentioned above may be used in an amount within the range of 0.1 to 20 g per $m^2$ of a support used, provided that the amount thereof used may be varied according to the purposes of the application thereof and to the single-layered structure or the multilayered structure.

For the purposes of improving a sensitivity and an image density, a ligand exchanging agent (such as a compound as described in JP OPI Publication No. 59-95529/1984, p. 10) and an imido compound may be added to a cobalt complex-containing layer of the invention or to the layers adjacent thereto.

The imido compounds include, for example, the compounds represented by the following formula (3);

Formula V

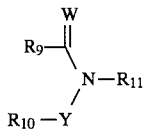

wherein $R_9$ and $R_{10}$ represent independently an alkyl group such as a methyl group, an ethyl group or a propyl group, or $R_9$ and $R_{10}$ may be coupled to each other so as to form a saturated or unsaturated carbon ring or heterocyclic ring. These rings may also have a substituent such as an alkyl group, an alkoxy group, a nitro group or a halogen atom.

$R_{11}$ represents a hydrogen atom or a group capable of splitting off upon applying heat thereto such as $—Si(R_5)_3$, $—CONHR_5$ or $—COR_5$. W is an oxygen atom or a sulfur atom and Y is a carbony group or a thiocarbonyl group. The concrete examples thereof include such a compound as succinimide, phthalimide, 2-methyl succinimide, dithiouracil, 5-methyl-5-pentyl hydantoin, phthalimide, nitrophthalimide, 2,3,4,5-tetrachlorophthalimide, 5,5'-dimethyloxazolone, diphenyl hydantoin, maleinimide, glutarimide, pyromellitimide, N-(trimethylsilyl)phthalimide, hydantoin, 3-methyl phthalimide and 4-octyl phthalimide.

A ligand-exchaging agent or an imido compound may be added in a proportion within the range of 0.1 to 20 mol % of an amount of, for example, a cobalt complex of the invention, provided that the amount added may be varied according to the constitution or the purpose of an image forming element used.

A photosensitive layer of the invention can be formed in such a manner that a photosensitive layer coating solution is prepared by dissolving or dispersing fine-particlewise a cobalt complex having formula I, a cobalt compound having formula II or phthalaldehyde having formula III and a binder in a solvent, and the resulting coating solution is coated on a support and is then dried up. The photosensitive layer is to have a dried layer thickness within the range of, preferably, 0.1 to 50 μm and, more preferably, 0.1 to 10 μm.

Any supports may be served as a support of the invention, provided that it is excellent in dimensional stability and resistive against heat when carrying out a development. Therefore, a transparent plastic film support excellent in heat resistance may be used for. The concrete examples thereof include those comprising such a polymer as polyethylene terephthalate, polysulfone, polycarbonate and polyimide. These supports are commonly to have a thickness within the range of 10 μm to 200 μm.

In the invention, for the purposes of improving the stability of an image to be formed and increasing the density of the image, it is preferable to provide a protective layer comprising at least a binder to the upper layer of a photosensitive layer. As for the binder applicable to the protective layer, the same binders as given for the aforementioned photosensitive layer may be used. These binders may be used independently or in combination. The layer thickness thereof is to be, preferably, within the range of 0.5 to 5 μm. An image element may further have an intermediate layer and a subbing layer.

To an image forming element applicable to the invention, for the purpose of improving an image durability, it is allowed that a UV-absorbent and an antioxidizer each given in JP OPI Publication Nos. 59-158289/1984, 59-182785/1984, 60-130735/1985, 61-118748/1986, 61-153638/1986 and 61-159644/1986 may be contained therein as an additive.

The other additives include, for example, a variety of matting agents, colloidal silica, lubricants, organic fluoro compounds, antistatic agents, high-boiling organic solvents, plasticizers and polymer latexes.

An image forming methods in which an image forming element of the invention is used will be described below.

When exposing imagewise an image forming element of the invention to light, a latent image is so formed as to meet the exposure quantity applied thereto and, when heating the element successively, an exposed area is developed so that an image can be obtained. When the image forming element is treated with an acid after applying heat, an image can be fixed.

When making an acidic treatment, an element can be fixed in such a manner that it is exposed to hydrogen chloride gas for about one minute, that it is heated upon superposing a sheet containing an acid component on the element, or that an acid component is contained in the other layer and the resulting layer is then brought into contact with the element by applying heat, after making an exposure.

The above-mentioned acid component may be either an inorganic acid component or an organic acid component. The examples thereof include, typically, acetic acid, hydrochloric acid and tosylic acid.

In a method for exposing an image forming element of the invention to light, tungsten light, mercury lamp, halogen lamp, xenon lamp, laser beam, light-emitting diode and CRT may be used.

There is no special limitation to the above-mentioned heating methods. However, the methods include, for example, a method in which a post-exposed image forming element is transported to a heating drum, another method in which an element is heated by a heat block, and a further method in which an element is transported to the inside of a heated furnace. As the heating conditions, it is preferable, from the viewpoints of the separability between an image density and a fogginess and a resolving power, that the subject element is heated at a temperature within the range of 60° to 170° C., preferably, 70° to 160° C. for 2 to 60 seconds.

EXAMPLES

Example 1

Preparation of an Image Forming Element and the Evaluation Thereof

A solution for coating a photosensitive layer relating to the invention was prepared by mixing the following raw materials.

| | |
|---|---|
| Cobalt complex of formula II (C-1) | 0.56 g |
| o-phthalaldehyde | 0.4 g |
| Acrylonitrile-styrene copolymer, (in the composition ratio of 3:7) | 1.2 g |
| Methylethyl ketone | 2.5 ml |
| Toluene | 2.5 ml |

The above-given coating solution was coated on a 100 μm-thick polyethylene terephthalate (PET) base by making use of a wire-bar, so as to have a wet layer thickness of 100 μm and was then dried. Thereby, image forming element 1 having a photosensitive layer could be prepared on the PET base.

In the same manner as above, image forming elements 2 through 5 of the invention having the same constitution as element 1 and comparative image forming elements 6 and 7 were each prepared, except that the cobalt complex of the image forming element 1 was replaced by a cobalt complex shown in Table 1. Besides, elements 8 through 16 were also prepared in such a manner that the imide compound shown in Table 1 was added each to image forming elements 1, 2, 5 and 6 and 7, respectively.

In these samples cobalt complex of formula II also functions as a cobalt complex of formula I.

Image forming elements 1 through 16 were each exposed imagewise to light upon superposing an image wedge thereon, and they were heated at 110° C. for 5 minutes, respectively.

Table 1 shows an exposure quantity for obtaining density 1, the maximum density (of the transmission density) and fog. The densities were measured through blue rays of light.

When the resulting images were wrapped up in black paper and preserved for 4 days at 50° C., respectively, with the images formed of the elements without providing any protective layer thereto (Nos. 1, 2, 5, 8, 13, 14), the density was observed to be slightly decreased (by about 0.1) and a slight image bleeding was also visually observed. On the other hand, with the elements having the protective layers Nos. 17 through 22, any density decrease and image bleeding were not observed at all.

Therefore, it was proved that an image having a higher density can be obtained and, at the same time, an image preservability can also be improved, by providing a protective layer to an element.

TABLE 1

| Image forming element | Cobalt complex | Imide compound (Amt. added: g/m$^2$) | Exposure Q'ty (mj/cm$^2$) | Dmax | Dmin |
|---|---|---|---|---|---|
| 1 (Invention) | C-1 | Nil | 4 | 3.6 | 0.15 |
| 2 (Invention) | C-2 | Nil | 2.5 | 3.5 | 0.13 |
| 3 (Invention) | C-6 | Nil | 4 | 3.4 | 0.13 |
| 4 (Invention) | C-7 | Nil | 3.5 | 3.4 | 0.14 |
| 5 (Invention) | C-9 | Nil | 5 | 3.3 | 0.15 |
| 6 (Comparison) | Comparison A | Nil | Image not obtainable | | |
| 7 (Comparison) | Comparison B | Nil | Image not obtainable | | |
| 8 (Invention) | C-1 | I-1 (0.1) | 0.2 | 3.7 | 0.16 |
| 9 (Invention) | C-1 | I-1 (0.2) | 0.15 | 3.8 | 0.16 |
| 10 (Invention) | C-1 | I-2 (0.1) | 0.2 | 3.7 | 0.15 |
| 11 (Invention) | C-1 | I-3 (0.1) | 0.2 | 3.7 | 0.17 |
| 12 (Invention) | C-1 | I-4 (0.1) | 0.25 | 3.7 | 0.16 |
| 13 (Invention) | C-2 | I-1 (0.1) | 0.1 | 3.8 | 0.15 |
| 14 (Invention) | C-9 | I-1 (0.1) | 0.3 | 3.5 | 0.16 |
| 15 (Comparison) | Comparison A | I-1 (0.1) | Image not obtainable | | |
| 16 (Comparison) | Comparison B | I-1 (0.1) | Image not obtainable | | |

Imide compound I-1: 5,5'-dimethyl oxazolone
I-2: Nitrophthalimide
I-3: Diphenyl hydantoin
I-4: 4-octyl phthalimide
Comparative compound A: $Co^{3+}(NH_3)_6(CF_3COO^-)_3$
B: $Co^{3+}(NH_2CH_2CH_2NH_2)_3(CF_3COO^-)_3$

Example 2

Evaluation on the Protective Layer

On each of the photosensitive layers of image forming elements 1, 2, 5, 8, 13 and 14 of Example 1, a protective layer comprising a mixture of gelatin for photographic photosensitive material use and polyvinyl pyrrolidone (K30) in the composition ratio of 7:3 and a polyvinyl pyrrolidone-vinyl acetate copolymer in a composition ratio of 7:3 was coated so as to have a layer thickness of 2 μm, which are herein referred to as image forming elements 17 to 22, respectively.

When exposing the resulting image forming elements to light in the same manner as in Example 1 and then developing them, the maximum densities thereof were increased to be within the range of 0.2 to 0.3, as compared to the case where no protective layer was provided. Besides, it was observed that any fog density was least increased.

Example 3

Preservability of an Image Forming Element

The above-mentioned image forming elements 1 through 22 were preserved for 4 days under the conditions of 50° C. and 70% RH. To comparative image forming elements (Nos. 6, 7, 15, 16), 2-isopropoxy naphthoquinone was added as a photoreducing agent so as to form an image. The amounts thereof added was equivalent to the mols of a cobalt complex.

When exposing the elements after they were preserved to light and then developing them in the same manner as in Example 1, the image forming elements of the invention were proved that the background densities thereof, i.e., the fog densities thereof, were not increased only by not higher than 0.1, and the elements provided particularly with the protective layer were proved that the densities thereof were increased only by not higher than 0.05. Also, any photosensitivity lowering was not observed.

With the comparative image forming elements, on the other hand, the fog densities thereof were increased by 0.2 to 0.3 and the sensitivities thereof were lowered by 30% approximately. Besides, among the comparative image forming elements to which the photoreducing agent was added, the elements not added by any imido compound had a sensitivity of 20 to 30 mJ/cm$^2$ prior to the preservation, and the elements added by imidazole had a sensitivity of 0.5 to 1 mJ/cm$^2$ prior to the preservation.

In other words, an image forming element of the invention is more excellent in preservability and higher in sensitivity as well in comparison with an image forming element applied with a conventionally known cobalt complex.

Example 4

Addition of a Cobalt Complex Compound and a Dialdehyde Compound to a Separate Layer A methylethyl ketone solution containing 0.56 g of cobalt complex C-1, an imido compound I-1 and 0.6 g of butyral resin was coated in an amount of 12 cc on a 100 μm-thick PET film so as to have a wet layer thickness of 100 μm and then dried up. Successively, 5 cc of an ethanol solution containing 0.4 g of o-phthalaldehyde and 1.0 g of polyvinyl pyrrolidone-vinyl acetate copolymer having a composition ratio of 3:7 was coated thereon so as to have a wet layer thickness of 50 μm and then dried up. Further, a gelatin layer having a thickness of 1 μm was arranged as a protective layer, so that image forming element 23 could be prepared. Besides the above, image forming element 24 was prepared to have the same constitution as in element 29, except that C-1 was replaced by C-2.

When image forming elements 23 and 24 were exposed to light and then developed in the same manner as in Example 1, the images having Dmax of 3.7, Dmin of 0.13 and Dmax of 3.5 and Dmin of 0.12 could be obtained, respectively.

When these image forming elements were preserved for 3 days and for 5 days each under the conditions of 50° C. and 70% RH, any sensitivity lowering and any fog increase were not observed in any one of the conditions.

Example 5

Study on the Image Forming or Developing Conditions

After exposing image forming element 1 to light, a development was carried out under the conditions changed as follows. The resulting Dmax and Dmin thereof were measured. The results thereof were as follows.

| Development temperature | Development time | Dmax | Dmin |
|---|---|---|---|
| 110° C. | 5 sec. | 3.6 | 0.15 |
| 90° C. | 15 sec. | 3.4 | 0.16 |
| 70° C. | 50 sec. | 3.2 | 0.17 |
| 70° C. | 70 sec. | 3.3 | 0.26 |
| 60° C. | 60 sec. | 2.5 | 0.20 |
| 130° C. | 3 sec. | 3.7 | 0.16 |
| 160° C. | 2 sec. | 3.7 | 0.18 |
| 70° C. | 2 sec. | 3.7 | 0.25 |

As for the development conditions of an image forming element of the invention, it is preferable to make a development at a temperature within the range of 70° to 160° C. and for a time within the range of 2 to 60 seconds.

Example 6

Preparation of an Image Forming Element and the Evaluation Thereof

The coating solution for a photosensitive layer relating to the invention was prepared by mixing the following raw materials together.

| | |
|---|---|
| Cobalt complex of formula II (C-1) | 0.26 g |
| Cobalt complex of formula I (Co-1) | 0.46 g |
| o-phthalaldehyde | 0.4 g |
| Polyvinyl butyral resin, (BL-1: manufactured by Sekisui Chemical Co.) | 1.2 g |
| Methylethyl ketone | 2.5 cc |
| Toluene | 2.5 cc |

The resulting coating solution was coated on a 100 μm-thick PET base by making use of a wire-bar so as to have a wet layer thickness of 100 μm and the dried up, so that image forming element 101 comprising a PET film bearing thereon a photosensitive layer could be prepared.

Image forming elements of the invention 102 through 105 and comparative image forming elements 106 and 107 each were prepared in the same manner as in image forming element 101 so as to have the same constitution as in image forming element 101, except that cobalt complex used in element 101 was replaced by those shown in Table 2. Besides the above, elements 108 through 114 were also prepared by adding the imido compounds shown in Table 2 to image forming elements 101 through 107, respectively.

Image forming elements 101 through 114 were exposed imagewise to UV rays by superposing an image wedge thereon and were then heated for 5 seconds at 110° C.

Table 2 shows an exposure quantities required for obtaining density 1, the maximum density (or a transmission density) and fog. The densities were measured through blue light.

TABLE 2

| Image forming element | Cobalt complex (C/Co) | Imide compound (Amt. added: g/m$^2$) | Exposure Q'ty (mj/cm$^2$) | Dmax | Dmin |
|---|---|---|---|---|---|
| 101 (Invention) | C-1/Co-1 | Nil | 3.5 | 3.9 | 0.14 |
| 102 (Invention) | C-2/Co-2 | Nil | 2.0 | 3.8 | 0.13 |
| 103 (Invention) | C-6/Co-1 | Nil | 3.5 | 3.7 | 0.12 |
| 104 (Invention) | C-7/Co-1 | Nil | 3.0 | 3.7 | 0.14 |
| 105 (Invention) | C-9/Co-1 | Nil | 4.5 | 3.6 | 0.14 |
| 106 (Comparison) | — Co-1 | Nil | Image not obtainable | | |
| 107 (Comparison) | — Co-2 | Nil | Image not obtainable | | |
| 108 (Invention) | C-1/Co-1 | I-1 (0.1) | 0.15 | 4.1 | 0.15 |
| 109 (Invention) | C-2/Co-2 | I-1 (0.2) | 0.10 | 4.2 | 0.15 |
| 110 (Invention) | C-6/Co-1 | I-2 (0.1) | 0.20 | 4.1 | 0.14 |
| 111 (Invention) | C-7/Co-1 | I-3 (0.1) | 0.10 | 4.1 | 0.14 |
| 112 (Invention) | C-9/Co-1 | I-4 (0.1) | 0.25 | 3.8 | 0.15 |
| 113 (Comparison) | — Co-1 | I-1 (0.1) | Image not obtainable | | |
| 114 (Comparison) | — Co-2 | I-1 (0.1) | Image not obtainable | | |

Example 7

Evaluation on Protective Layer

On each of the photosensitive layers of image forming elements 101, 102, 105, 108 and 112 of Example 6, a protective layer comprising a mixture of gelatin for photographic photosensitive material use and polyvinyl pyrrolidone (K30) in the composition ratio of 7:3 and a polyvinyl pyrrolidone-vinyl acetate copolymer in a composition ratio of 7:3 was coated so as to have a layer thickness of 2 μm, which are herein referred to as image forming elements 115 to 119, respectively.

When exposing the resulting image forming elements to light in the same manner as in Example 1 and then developing them, the maximum densities thereof were increased to be within the range of 0.2 to 0.3, as compared to the case where no protective layer was provided. Besides, it was observed that any fog density was least increased.

When the resulting images were wrapped up in black paper and preserved for 4 days at 50° C., respectively, with the images formed of the elements without providing any protective layer thereto Nos. 101, 102, 105, 108, 112, the density was observed to be slightly decreased by about 0.1 and a slight image bleeding was also visually observed. On the other hand, with the elements having the protective layers Nos. 115 through 119, any density decrease and image bleeding were not observed at all.

Therefore, it was proved that an image having a higher density can be obtained and, at the same time, an image preservability can also be improved, by providing a protective layer to an element.

Example 8

Preservability of an Image Forming Element

The above-mentioned image forming elements 101 through 119 were preserved for 4 days under the conditions of 50° C. and 70% RH. To comparative image forming elements Nos. 106, 107, 113, 114, 2-isopropoxy naphthoquinone was added as a photoreducing agent so as to form an image. The amounts thereof added was equivalent to the mols of a cobalt complex.

When exposing to light the elements after they were preserved and then developing them in the same manner as in Example 6, the image forming elements of the invention were proved that the background densities thereof, i.e., the fog densities thereof, were not increased only by not higher than 0.1, and the elements provided particularly with the protective layer were proved that the densities thereof were increased only by not higher than 0.05. Also, any photosensitivity lowering was not observed.

With the comparative image forming elements, on the other hand, the fog densities thereof were increased by 0.2 to 0.3 and the sensitivities thereof were lowered by 30% approximately. Besides, among the comparative image forming elements to which the photoreducing agent was added, the elements not added by any imido compound had a sensitivity of 20 to 30 mJ/cm$^2$ prior to the preservation, and the elements added by imidazole had a sensitivity of 0.5 to 1 mJ/cm$^2$ prior to the preservation.

In other words, an image forming element of the invention is more excellent in preservability and higher in sensitivity as well in comparison with an image forming element applied with a conventionally known cobalt complex.

Example 9

Addition of a Cobalt Complex Compound and a Dialdehyde Compound to Separate Sublayers A methylethyl ketone solution containing 0.35 g of cobalt complex of formula II (C-1), 0.45 g of cobalt complex of formula I (Co-1), an imido compound (I-1) and 0.6 g of butyral resin was coated in an amount of 12 cc on a 100 μm-thick PET film so as to have a wet layer thickness of 100 μm and then dried up. Successively, 5 cc of an ethanol solution containing 0.4 g of o-phthalaldehyde and 1.0 g of polyvinyl pyrrolidonevinyl acetate copolymer having a composition ratio of 3:7 was coated thereon so as to have a wet layer thickness of 50 μm and then dried up. Further, a gelatin layer (having a thickness of 1 μm) was arranged as a protective layer, so that image forming element 120 could be prepared. Besides the above, image forming element 121 was prepared to have the same constitution as in element 120, except that C-1 was replaced by C-2.

When image forming elements 120 and 121 were exposed to light and then developed in the same manner as in Example 1, the images having Dmax of 4.0, Dmin of 0.13 and Dmax of 3.9 and Dmin of 0.12 could be obtained, respectively.

When these image forming elements were preserved for 3 days and for 5 days each under the conditions of 50° C. and 70% RH, any sensitivity lowering and any fog increase were not observed in any one of the conditions.

Example 10

Study on the Image Forming or Developing Conditions

After exposing image forming element 101 to light, a development was carried out under the conditions changed as follows. The resulting Dmax and Dmin thereof were measured. The results thereof were as follows.

| Development temperature | Development time | Dmax | Dmin |
|---|---|---|---|
| 110° C. | 5 sec. | 3.9 | 0.15 |
| 90° C. | 15 sec. | 3.8 | 0.15 |
| 70° C. | 50 sec. | 3.6 | 0.17 |
| 70° C. | 70 sec. | 3.6 | 0.25 |
| 60° C. | 60 sec. | 2.8 | 0.21 |
| 130° C. | 3 sec. | 3.8 | 0.16 |
| 160° C. | 2 sec. | 3.8 | 0.171 |
| 70° C. | 2 sec. | 3.8 | 0.24 |

As for the development conditions of an image forming element of the invention, it is preferable to make a development at a temperature within the range of 70° to 160° C. and for a time within the range of 2 to 60 seconds.

Example 11

The coating solution for a photosensitive layer relating to the invention was prepared by mixing the following raw materials together.

| | |
|---|---|
| Cobalt complex of formula I (Co-1) | 1.8 g |
| Dye of formula III (D-38) | 0.9 g |
| o-phthalaldehyde | 2.9 g |
| Polyvinyl butyral resin, (BL-1: manufactured by Sekisui Chemical Co.) | 8.0 g |
| Methylethyl ketone | 250 ml |
| Acetone | 100 ml |

The resulting coating solution for photosensitive layer use was coated on a 100 μm-thick PET base by making use of a wire-bar so as to make the coated amount to be 1.4 g/m2 and then dried up, so that image forming element 201 comprising a PET film bearing thereon a photosensitive layer could be prepared. Besides the above, image forming elements 202 through 207 of the invention having the same constitution as those of image forming element 201 were prepared in the same manner as in element 201, except that the cobalt complex and the dye of element 201 were replaced by those shown below. As for the comparison, comparative image forming element 208 was prepared by replacing comparative dye A in place of the dye of image forming element 201. Further, comparative image forming element 209 was prepared by adding 2-isopropyloxy naphthoquinone as a photoreducing agent in a mol equivalent to that of the dye in place of the dye of comparative image forming element 208.

The resulting image forming elements 201 through 209 were exposed to xenon lamp upon superposing an image wedge and then by interposing a filter capable of cutting the rays of not longer than 500 nm between the elements and the xenon lamp. After making the exposure, each image forming element was heated at 110° C. for 20 seconds, so that image forming elements 201 through 207 could form the black images in the exposed areas thereof. On the other hand, any image formation could not observed at all in comparative elements 208 and 209.

The transmission densities of the resulting images were measured through red light. The results thereof will be shown below.

| Image forming element | Co complex | Dye | Dmax | Dmin |
|---|---|---|---|---|
| 201 (Invention) | (Co-1) | D-38 | 2.52 | 0.25 |
| 202 (Invention) | (Co-2) | D-38 | 2.38 | 0.26 |
| 203 (Invention) | (Co-5) | D-38 | 2.25 | 0.26 |
| 204 (Invention) | (Co-11) | D-38 | 2.40 | 0.27 |
| 205 (Invention) | (Co-1) | D-14 | 2.55 | 0.26 |
| 206 (Invention) | (Co-1) | D-21 | 2.47 | 0.25 |
| 207 (Invention) | (Co-1) | D-29 | 2.50 | 0.24 |
| 208 (Comparison) | (Co-1) | A | 0.25 | 0.24 |
| 209 (Comparison) | (Co-1) | Quinone | 0.24 | 0.24 |

Comparative dye A

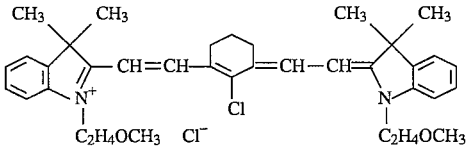

With an image forming element of the invention, an image having a high density and few fog can be obtained.

Example 12

The image forming elements prepared in Example 11 were preserved for 4 days under the conditions of 50° C. and 70% RH. When exposing to light the elements after they were preserved and then developing them in the same manner as in Example 6, the image forming elements of the invention were proved that the background densities thereof (i.e., the fog densities thereof) were not increased only by not higher than 0.1. With the comparative image forming elements, on the other hand, the fog densities thereof were increased by 0.2 to 0.3.

It is resultingly proved that the image forming elements of the invention can be excellent in preservability and stable without producing any fog that may be produced in a preservation.

Example 13

Image forming element 201 of the invention prepared in Example 6 was exposed to UV rays by making use of a UGRA Plate Control Wedge (PCW 82) 1982 and was then heated at 120° C. for 5 seconds.

The resulting image could reproduce a 4 μm-wide line and was, therefore, proved to have a high resolving power.

Example 14

Image forming element 201 was exposed scanningwise to semiconductive laser beam (having a wavelength of 820 nm). The exposure energy was 1 mj/cm$^2$ on the image forming element.

After completing the exposure, when the element was heated in the same manner as in Example 6, a black image corresponding to the exposed areas could be obtained.

When comparative image forming element 208 was exposed to light in the same manner as mentioned above, element 208 was proved that any image could not be formed at all.

What is claimed is:

1. An image forming element comprising a support having thereon an image forming layer comprising a binder, an aromatic aldehyde, a cobalt (III) complex represented by formula I, and a compound represented by formula III;

$$Co^{3+}(L)p(X)q \quad (I)$$

wherein L is ligand capable of forming a complex compound with the cobalt cation and at least one of which is $NH_3$ or a primary amine; X is a counter anion; p is an integer of 1 to 6; when p is 2 to 6, plural Ls may be the same or different; and q is an integer of 1 to 3, (III)

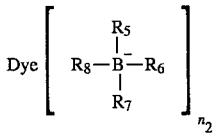

wherein Dye is a cationic dye; $R_5$, $R_6$, $R_7$ and $R_8$ are each independently an alkyl group, an aryl group, an aralkyl group, an alkenyl group, an alkinyl group, a heterocyclic group or a cyano group; $n_2$ is an integer of 1 to 3, when $n_2$ is 2 or 3, the plural counter ions may be the same or different.

2. The element of claim 1, wherein said cationic dye is a compound represented by the following formula D-1;

$$B-(L_1=L_2)_n-L_3=B' \quad (D\text{-}1)$$

wherein, B is a nitrogen containing heterocyclic group; B' is an aryl group or a heterocyclic group; $L_1$, $L_2$ and $L_3$ are each a methine group; and n is an integer of 0 to 3.

3. The element of claim 1, wherein the amount of said compound represented by formula 1 contained in said layer is 0.01 g/m$^2$ to 5 g/m$^2$.

4. The element of claim 1, wherein the amount of said compound represented by formula III contained in said layer is 0.01 g/m$^2$ to 5 g/m$^2$.

5. The element of claim 1, wherein the weight ratio of said compound represented by formula I to said compound represented by formula III is 0.01 to 0.5.

6. The element of claim 1, wherein said aromatic aldehyde is a dialdehyde compound represented by the following formula IV;

(IV)

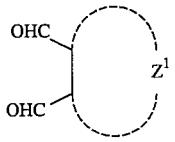

wherein $Z^1$ is a group of atoms necessary to form an aromatic ring which may have a substituent.

7. The element of claim 6, wherein said compound represented by formula IV is o-phthalaldehyde.

8. The element of claim 7, wherein the amount of o-phthalaldehyde contained in said layer is 0.5 mol to 30 mol per mole of said cobalt (III) complex represented by formula I.

9. The element of claim 1, wherein said layer further contains an imido compound represented by formula (V);

V

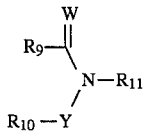

wherein $R_9$ and $R_{10}$ are each independently an alkyl group; R11 is a group capable of releasing by heat; and W is an oxygen atom or a sulfur atom; and Y is a carbonyl group or a thiocarbonyl group.

10. The element of claim 1, further comprising a protective Layer provided on said image forming layer.

11. The element of claim 1, wherein the amount of said compound represented by formula I contained in said layer is 0.01 g/m$^2$ to 5 g/m$^2$;

the amount of said compound represented by formula III contained in said layer is 0.01 g/m$^2$ to 5 g/m$^2$, and the weight ratio of said compound represented by formula I to said compound represented by formula III is 0.01 to 0.5.

12. The element of claim 2, wherein the amount of said compound represented by formula 1 contained in said layer is 0.01 g/m$^2$ to 5 g/m$^2$;

the amount of said compound represented by formula III contained in said layer is 0.01 g/m$^2$ to 5 g/m$^2$, and the weight ratio of said compound represented by formula I to said compound represented by formula III is 0.01 to 0.5.

13. A method for forming an image comprising steps of imagewise exposing to light an image forming layer of a image forming element, and heating said image forming element to form an image in said image forming layer, wherein said image forming element comprising a support having thereon said image forming layer comprising a binder, an aromatic aldehyde, a cobalt (III) complex represented by formula I, and a compound represented by formula III;

$$Co^{3+}(L)p(X)q \quad (I)$$

wherein L is a ligand capable of forming a complex compound with the cobalt cation and at least one of which is $NH_3$ or a primary amine; X is a counter anion; p is an integer of 1 to 6; when p is 2 to 6, plural Ls may be the same or different; and q is an integer of 1 to 3, (III)

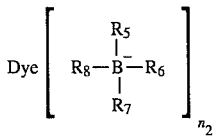

wherein Dye is a cationic dye; $R_5$, $R_6$, $R_7$ and $R_8$ are each independently an alkyl group, an aryl group, an aralkyl group, an alkenyl group, an alkinyl group, a heterocyclic group or a cyano group; $n_2$ is an integer of 1 to 3, when $n_2$ is 2 or 3, the plural counter ions may be the same or different.

14. The method of claim 13, wherein said heating step is carried out at a temperature of 70° C. to 160° C. for a time of 2 seconds to 60 seconds.

15. The method of claim 13, wherein said method further comprises the step of treating said image forming layer with an acid after the step of heating for fixing the formed image.

16. The method of claim 13, wherein said heating step is carried out at a temperature of 70° C. to 160° C. for a time of 2 seconds to 60 seconds; and said method further comprises the step of treating said image forming layer with an acid after the step of heating for fixing the formed image.

17. The method of claim 16, wherein the cationic dye is a compound represented by the following formula D-1:

$$B-(L_1=L_2)_n-L_3=B' \quad \text{(D-1)}$$

wherein, B is a nitrogen-containing heterocyclic group; B' is an aryl group or a heterocyclic group; $L_1$ $L_2$ and $L_3$ are each a methine group; and n is an integer of 0 to 3.

* * * * *